US010357826B2

(12) United States Patent
Bishop et al.

(10) Patent No.: US 10,357,826 B2
(45) Date of Patent: Jul. 23, 2019

(54) ALUMINUM ALLOY POWDER FORMULATIONS WITH SILICON ADDITIONS FOR MECHANICAL PROPERTY IMPROVEMENTS

(71) Applicant: GKN SINTER METALS, LLC, Auburn Hills, MI (US)

(72) Inventors: Donald Paul Bishop, Stillwater Lake (CA); Richard L. Hexemer, Jr., Granite Falls, NC (US); Ian Donaldson, Jefferson, MA (US); Randy Williams Cooke, Dartmouth (CA)

(73) Assignee: GKN Sinter Metals, LLC, Auburn Hills, MI (US)

( * ) Notice: Subject to any disclaimer, the term of this patent is extended or adjusted under 35 U.S.C. 154(b) by 296 days.

(21) Appl. No.: 15/303,155

(22) PCT Filed: Apr. 8, 2015

(86) PCT No.: PCT/US2015/024913

§ 371 (c)(1),
(2) Date: Oct. 10, 2016

(87) PCT Pub. No.: WO2015/157411

PCT Pub. Date: Oct. 15, 2015

(65) Prior Publication Data

US 2017/0028469 A1 Feb. 2, 2017

Related U.S. Application Data

(60) Provisional application No. 61/978,461, filed on Apr. 11, 2014.

(51) Int. Cl.
*B22F 1/00* (2006.01)
*C22C 21/14* (2006.01)
(Continued)

(52) U.S. Cl.
CPC ..... *B22F 1/0081* (2013.01); *B22F 1/0003* (2013.01); *B22F 3/1035* (2013.01);
(Continued)

(58) Field of Classification Search
None
See application file for complete search history.

(56) References Cited

U.S. PATENT DOCUMENTS 4,177,069 A 12/1979 Kobayashi et al.
5,545,487 A * 8/1996 Ishijima ..... C22C 1/0416 428/545

(Continued)

FOREIGN PATENT DOCUMENTS

CN 103260796 A 8/2013
CN 103 421 992 12/2013

(Continued)

OTHER PUBLICATIONS

The State Intellectual Property Office of People's Republic of China, Application No. 201580019089.9, First Office Action and Search Report, dated Jan. 23, 2018, 22 pages.

(Continued)

*Primary Examiner* — George Wyszomierski
(74) *Attorney, Agent, or Firm* — Quarles & Brady LLP

(57) ABSTRACT

An improved aluminum alloy powder metal includes silicon additions. When this improved powder metal with silicon additions is sintered to form a sintered component, the resultant component exhibits many improved mechanical strength properties and improved thermal resistance.

8 Claims, 1 Drawing Sheet

(51) Int. Cl.

| | |
|---|---|
| ***C22C 21/16*** | (2006.01) |
| ***B22F 3/10*** | (2006.01) |
| ***C22C 1/04*** | (2006.01) |
| ***B22F 3/16*** | (2006.01) |

(52) U.S. Cl.
CPC ..... *B22F 3/16* (2013.01); *C22C 1/0416* (2013.01); *C22C 21/14* (2013.01); *C22C 21/16* (2013.01); *B22F 2201/02* (2013.01); *B22F 2302/45* (2013.01); *B22F 2303/01* (2013.01); *B22F 2303/05* (2013.01); *B22F 2998/10* (2013.01); *B22F 2999/00* (2013.01)

(56) References Cited

U.S. PATENT DOCUMENTS

2005/0036899 A1* 2/2005 Lindenau ..... B22F 3/02 419/38
2006/0045787 A1* 3/2006 Jandeska, Jr. ..... B22F 1/025 419/47
2013/0183189 A1* 7/2013 Bishop ..... B22F 9/082 419/62
2013/0309123 A1 11/2013 Bishop et al.
2013/0333870 A1* 12/2013 Bishop ..... C22C 1/0416 165/185

FOREIGN PATENT DOCUMENTS

| | | | |
|---|---|---|---|
| EP | 0 436 952 | | 7/1991 |
| EP | 0669404 | A2 | 8/1995 |
| JP | H07224341 | A | 8/1995 |
| JP | 2003342660 | A | 12/2003 |
| WO | 2009/140726 | | 11/2009 |
| WO | 2012/082877 | | 6/2012 |

OTHER PUBLICATIONS

The International Search Report and Written Opinion dated Jul. 7, 2015 for International Application No. PCT/US2015/024913.
Mosher, W. G. E. et al., "On enhancement of hypoeutectic aluminum-silicon powder metallurgy alloy," Canadian Metallurgical Quarterly, Pergamon, Canada, vol. 51, No. 1, Jan. 1, 2012 (Jan. 1, 2012),pp. 39-47, XP008176762, ISSN: 0008-4433.
Japan Patent Office, Notice of Reasons for Rejection, Application No. 2016-561317, dated Jan. 22, 2019, 17 pages.

* cited by examiner

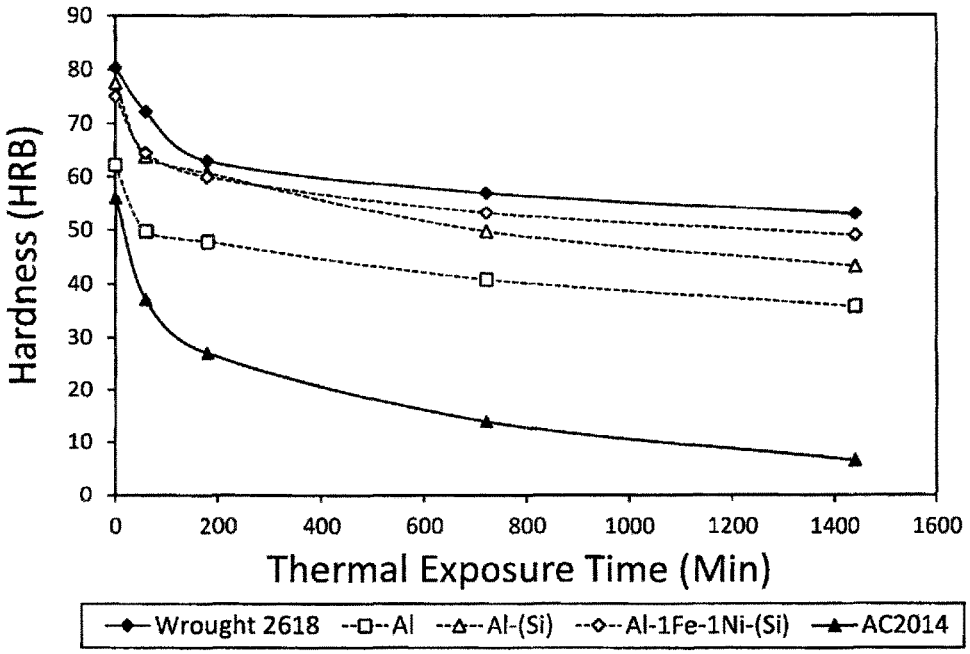
Hardness (HRB)
90
80
70
60
50
40
30
20
10
0
0
200
400
600
800
1000
1200
1400
1600
Thermal Exposure Time (Min)
Wrought 2618
Al
Al-(Si)
Al-1Fe-1Ni-(Si)
AC2014

ALUMINUM ALLOY POWDER FORMULATIONS WITH SILICON ADDITIONS FOR MECHANICAL PROPERTY IMPROVEMENTS

CROSS-REFERENCE TO RELATED APPLICATION

This application represents the national stage entry of PCT International Application No. PCT/US2015/024913 filed on Apr. 8, 2015 and claims the benefit of the filing date of U.S. Provisional Patent Application No. 61/978,461 entitled "Aluminum Alloy Powder Metal Formulations with Silicon Additions for Mechanical Property Improvements" filed on Apr. 11, 2014, which is hereby incorporated by reference for all purposes as if set forth in its entirety herein.

STATEMENT OF FEDERALLY SPONSORED RESEARCH OR DEVELOPMENT

Not applicable.

BACKGROUND

This disclosure relates to powder metallurgy. In particular, this disclosure relates to the use of silicon additions to drastically improve mechanical properties in certain aluminum alloy systems.

Powder metallurgy is well-suited for the production of high-volume parts in which the parts have relatively detailed features. In powder metallurgy, an initial powder metal is compacted in a tool and die set to form a preform. This preform is then sintered to order to fuse the particles of the powder metal to form a single body. Sintering is largely a solid state diffusion-driven process in which adjacent particles neck into one another; however, depending on the particular powder chemistry, a small amount of liquid phase may also develop that assists in the sintering and densification of the part. In any event, apart from some amount of dimensional shrinkage, the sintered part largely retains the shape of the as-compacted preform. After sintering, the sintered part may then be subjected to post-sintering processes such as, for example, forging, machining, heat treatments, and so forth in order to provide a final component with the desired shape, dimensional accuracy, and microstructure.

Despite the many advantages of powder metallurgy, because powder metal parts are produced by these processes, there is often a compromise in the mechanical qualities of the part in comparison to their wrought counterparts. For example, because a cast wrought part is fully dense, this wrought part usually exhibits superior strength properties in comparison to a sintered powder metal part having a similar chemistry. This difference can be attributable, in part, to the process used to form the components and the fact that the as-sintered part often is less than fully dense.

Hence, while powder metallurgy provides an economical process for the production of high-volume parts, there remains a need for improving the mechanical properties of the resultant sintered components.

SUMMARY

Various chemical modifications were made to a baseline aluminum alloy powder metal system. These modifications included the separate and combined inclusion of a relatively small amount of silicon (approximately 0.2% by weight and in the range of 0.1 to 0.3 weight percent) and prealloyed copper and/or iron. The modified powder chemistries exhibited exceptional and surprising mechanical improvements without presenting any unacceptable side effects.

Silicon posed no impediments on sintering given that each alloy system sintered to near full theoretical density (>99%). Once heat treated to the T6 condition, silicon promoted significant gains in yield strength (20-30%) and UTS (10-20%) in each instance. Data also confirmed that the beneficial effects of silicon persevered during prolonged thermal exposure at temperatures as high as 260° C. Ultimately, the most desirable combination of properties was achieved in the Al-2.3Cu-1.6Mg-0.2Sn system prepared with prealloyed iron and nickel (1 weight percent additions of each, prealloyed with aluminum in one of the powder constituents) coupled with silicon modification (0.2 weight percent silicon provided in the powder as an Al-12Si master alloy, approximating the eutectic composition to depress its melting point to create a liquid phase during sintering). The performance of this sintered alloy was comparable to wrought 2618-T6 and greatly exceeded that of the conventional commercial powder metal blend AC2014-T6.

According to one aspect, a powder metal composition includes an atomized aluminum powder metal in which the aluminum powder is prealloyed with iron separately, nickel separately, or iron and nickel together and further includes a first master alloy powder metal comprising aluminum and copper, a second master alloy powder metal comprising aluminum and silicon, a first elemental powder metal comprising magnesium, and a second elemental powder metal comprising tin.

In some forms, the second master alloy comprising aluminum and silicon may be an Al-12Si master alloy.

In some forms, the first master alloy powder metal comprising aluminum and copper may be an Al-50Cu master alloy, the second master alloy comprising aluminum and silicon may be an Al-12Si master alloy, and the first and second elemental powder metals may be high purity elemental powder metals.

In one specific form, the powder metal composition may include 2.3 weight percent copper, 1.6 weight percent magnesium, 0.2 weight percent tin, and 0.2 weight percent silicon. In this form, the powder metal composition may potentially include 1.0 weight percent iron, 1.0 weight percent nickel, or 1.0 weight percent iron and 1.0 weight percent nickel.

In some forms, the powder metal composition may include 1.5 weight percent admixed Licowax C powder.

In some forms of the powder metal composition, the weight percent of silicon in the powder metal composition may be in a range of 0.1 to 0.3 weight percent such as, for example, 0.2 weight percent.

According to another aspect, a method of improving the mechanical properties of a sintered component made from an Al—Cu—Mg—Sn alloy powder metal mixture by doping the Al—Cu—Mg—Sn alloy powder metal mixture with a silicon addition is performed. The method includes adding silicon as a constituent to the Al—Cu—Mg—Sn alloy powder metal mixture, compacting the Al—Cu—Mg—Sn alloy powder metal mixture to form a preform, and sintering the preform to form the sintered component.

In some forms of the method, the step of sintering may occur in an atmosphere of high purity nitrogen.

In some forms of the method, the silicon may be provided as an Al-12Si master alloy powder metal having a eutectic temperature of approximately 577° C. at which the Al-12Si master alloy powder metal melts to form a liquid phase and the sintering may occur at a sintering temperature above the eutectic temperature. At the start of the sintering step, the liquid phase from the Al-12Si master alloy powder metal may be formed and transported between the un-sintered particles of the Al—Cu—Mg—Sn alloy powder metal mixture via capillary force. The silicon in the liquid phase from the Al-12Si master alloy powder metal may diffuse from the liquid phase into other solid aluminum grains in the Al—Cu—Mg—Sn alloy powder metal mixture.

In some forms of the method, the Al—Cu—Mg—Sn alloy powder metal mixture can include an atomized aluminum powder metal in which the aluminum powder is prealloyed with iron separately, nickel separately, or iron and nickel together and can further include a first master alloy powder metal comprising aluminum and copper, a second master alloy powder metal comprising aluminum and silicon, a first elemental powder metal comprising magnesium, and a second elemental powder metal comprising tin. In some forms, the second master alloy comprising aluminum and silicon may be an Al-12Si master alloy. In other forms, the first master alloy powder metal comprising aluminum and copper may be an Al-50Cu master alloy, the second master alloy comprising aluminum and silicon may be an Al-12Si master alloy, and the first and second elemental powder metals may be high purity elemental powder metals. In still other forms, Al—Cu—Mg—Sn alloy powder metal mixture may include 2.3 weight percent copper, 1.6 weight percent magnesium, 0.2 weight percent tin, and 0.2 weight percent silicon. In these forms, it is contemplated that the Al—Cu—Mg—Sn alloy powder metal mixture may include 1.0 weight percent iron, 1.0 weight percent nickel, or 1.0 weight percent iron and 1.0 weight percent nickel. In some instances, the Al—Cu—Mg—Sn alloy powder metal mixture may include 1.5 weight percent admixed Licowax C powder. In some forms, the weight percent of silicon in the Al—Cu—Mg—Sn alloy powder metal mixture may be in a range of 0.1 to 0.3 weight percent (for example 0.2 weight percent) to improve thermal stability of the mechanical properties of the sintered component.

In some forms, the weight percent of silicon in the Al—Cu—Mg—Sn alloy powder metal mixture may be in a range of 0.1 to 0.3 weight percent to improve thermal stability of the mechanical properties of the sintered component. In such forms, it is contemplated that the silicon may be added as part of an aluminum-silicon master alloy.

According to another aspect, a sintered component is made by the methods described herein.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

BRIEF DESCRIPTION OF THE DRAWINGS

FIG. 1 illustrates the effects of thermal exposure (temperature of 260° C.) on the hardness of wrought 2618 and select PM alloys. All materials were heat treated to the T6 temper condition.

DETAILED DESCRIPTION OF THE PREFERRED EMBODIMENTS

For the comparative data collected below, a nominal bulk chemistry of Al-2.3Cu-1.6Mg-0.2Sn and modifications to the chemistry of this baseline powder metal alloy system were evaluated. The Al-2.3Cu-1.6Mg-0.2Sn designation indicates that the aluminum alloy powder includes 2.3% by weight copper, 1.6% by weight magnesium and 0.2% by weight tin, with the balance or remaining percentage substantially comprising aluminum (excluding minor impurities). To modify the metallurgical attributes of the Al-2.3Cu-1.6Mg-0.2Sn base composition, trace additions of silicon, in an amount of approximately 0.2% by weight, were made in some of the prepared test specimens. In addition to measuring the effects of minor silicon additions to this Al-2.3Cu-1.6Mg-0.2Sn baseline system, variants of the baseline system (as well as this baseline system with silicon additions) were also prepared with prealloyed iron, prealloyed nickel, and both prealloyed iron and prealloyed nickel.

The nominal chemical compositions (in weight percent) of the various prepared test specimens are listed below in Table I.

TABLE I

| | Nominal chemistries (w/o) | | | | | | |
|---|---|---|---|---|---|---|---|
| Alloy | Al | Cu | Mg | Sn | Fe | Ni | Si |
| Al | Bal. | 2.3 | 1.6 | 0.2 | 0.0 | 0.0 | 0.0 |
| Al—1Fe | Bal. | 2.3 | 1.6 | 0.2 | 1.0 | 0.0 | 0.0 |
| Al—1Ni | Bal. | 2.3 | 1.6 | 0.2 | 0.0 | 1.0 | 0.0 |
| Al—1Fe—1Ni | Bal. | 2.3 | 1.6 | 0.2 | 1.0 | 1.0 | 0.0 |
| Al—(Si) | Bal. | 2.3 | 1.6 | 0.2 | 0.0 | 0.0 | 0.2 |
| Al—1Fe—(Si) | Bal. | 2.3 | 1.6 | 0.2 | 1.0 | 0.0 | 0.2 |
| Al—1Ni— (Si) | Bal. | 2.3 | 1.6 | 0.2 | 0.0 | 1.0 | 0.2 |
| Al—1Fe—1Ni—(Si) | Bal. | 2.3 | 1.6 | 0.2 | 1.0 | 1.0 | 0.2 |
| AC2014 | Bal. | 4.5 | 0.6 | 0.0 | 0.1 | 0.0 | 0.8 |
| Wrought 2618 | Bal. | 2.3 | 1.6 | 0.0 | 1.1 | 1.0 | 0.2 |

It can be seen that the first four test specimens were prepared without silicon additions including "Al" (which, in the naming convention, is shorthand for the Al-2.3Cu-1.6Mg-0.2Sn composition), Al-1Fe (which is Al-2.3Cu-1.6Mg-0.2Sn with an additional 1 percent iron by weight), Al-1Ni (which is Al-2.3Cu-1.6Mg-0.2Sn with an additional 1 percent nickel by weight), and Al-1Fe-1Ni (which is Al-2.3Cu-1.6Mg-0.2Sn with an additional 1 percent iron by weight and 1 percent nickel by weight). The second four test specimens have a similar composition to the first four test specimens, but also include 0.2% by weight silicon. To provide some context, these eight test specimens are compared to a commercial grade AC2014 powder sample and a wrought 2618 alloy (that is cast and not powder metal).

The powder metal composition and formulation of these various test samples can be important to the morphology of the final product. Atomized aluminum was the base material in all experimental formulations. In some instances, the atomized aluminum was pure aluminum, while in other instances the atomized aluminum was aluminum prealloyed with the full content of transition metals (iron, nickel, or both iron and nickel) indicated in the nominal chemistry. All other alloying constituents were sourced as discrete admixed powders. Copper and silicon were sourced in master alloy forms (Al-50Cu and Al-12Si, respectively) whereas magnesium and tin were added as high purity elemental powders. Each blend also included 1.5% admixed Licowax C powder for tooling lubrication purposes.

Test specimens were then industrially sintered in a continuous mesh belt furnace under an atmosphere of flowing high purity nitrogen. The measured oxygen content and dew points at the time of sintering were less than 5 ppm and less than −60° C., respectively. Targeted heating parameters of the sintering cycle included a 15 minute hold at 400° C. for de-lubrication followed by sintering at 610° C. for 20 minutes.

It is noted that the presentation of silicon in the master alloy powder of Al-12Si permits the formation of a liquid phase. The Al-12Si is a eutectic formulation that will melt completely above the eutectic temperature of 577° C. As this Al-12Si master alloy powder melts before bulk sintering of the compact commences (identified as 610° C. above, but might be within a range of 600-630° C.) or at a point kinetically at which minimal sintering has occurred via solid state diffusion, the liquid phase is able to quickly spread through the substantially un-sintered compact due to the abundance of capillary sites that exist within the compacted powder. The silicon then diffuses from the liquid phase into the solid aluminum grains in the powder metal mixture so as to ultimately yield a uniform silicon content throughout the sintered product.

Silicon should be kept at a low level (preferably, approximately 0.1 percent to approximately 0.3 percent by weight of the total aluminum alloy powder metal, although it is contemplated that silicon content might potentially be effective in a range between 0.05 and 0.8 weight percent) to establish any direct benefits from the addition. At greater silicon concentrations, such as above 0.3 percent by weight of the alloy, the silicon additions are ineffective with respect to thermal stability improvements and can actually cause the rate of softening to increase.

It is further noted that previously performed laboratory studies have demonstrated that prealloyed additions of iron and nickel can be successfully incorporated into this alloy system, albeit without consideration having been made with respect to silicon additions. See e.g., R.W. Cooke, R.L. Hexemer, I.W. Donaldson, and D.P. Bishop, "Dispersoid Strengthening of an Al—Cu—Mg PM Alloy Using Transition Metal Additions", Powder Metall. 55, No. 3, 2012, 191-199. This introduction of prealloyed iron and/or nickel can occur without any adverse effects on compaction or sintering. It was determined that the transition metal additions acted to form a homogenous distribution of intermetallic dispersoids within the sintered microstructure. Such phases were enriched in aluminum, the transition metal, and copper and acted to strengthen the alloy in the T1 state.

Returning now to the consideration of the silicon additions, the initial un-modified baseline Al system, Al-2.3Cu-1.6Mg-0.2Sn, was already highly responsive to industrial sintering and capable of attaining near full theoretical density with an excellent sinter quality. These traits were preserved in all of the chemical variants considered as neither iron, nickel, nor silicon compromised sintering behavior.

Singular additions of iron or nickel promoted the formation of aluminide intermetallics believed to be $Al_{13}Fe_4$ and $Al_3Ni$. While the presence of such phases would be expected to impart mechanical gains, modest reductions in tensile properties were actually observed as a result of copper scavenging. Simultaneous additions of both iron and nickel mitigated this effect as the resultant intermetallic species was a ternary formulation (most likely $Al_9FeNi$) that had a reduced propensity for copper solubility.

Minor additions of silicon had a universally positive effect on the hardness and tensile properties of all powder metal alloys considered. This occurred without any changes to sintering behavior or the observable microstructural features, thereby insinuating that the underlying precipitate structure had been refined.

The gains accrued through silicon doping were maintained under the conditions of thermal exposure studied as indicated by FIG. 1. FIG. 1 compares the hardness of various test specimen compositions, as well as AC2014 and wrought 2618, after holding the samples at a temperature of 260° C. for various time durations. All compared materials were heat treated to the T6 temper before being subjected to the thermal exposure test. From the data in FIG. 1, it can be seen that the Al-2.3Cu-1.6Mg-0.2Sn specimens better maintained hardness than the AC2014 comparative sample. Whereas the AC2014 sample had a hardness of less than 10 HRB after approximately 1400 minutes at 260° C., the Al-2.3Cu-1.6Mg-0.2Sn specimens all still exceeded 35 HRB after this exposure time. However, most notably, the Al-1Fe-1Ni—(Si) specimen performed nearly as well as the wrought 2618 comparative sample, with there being only a few points difference between the Al-1Fe-1Ni—(Si) test specimen and wrought 2618 at the different exposure times.

Various comparative mechanical properties of the samples were also collected. Table II below compares the mechanical properties of components made from the various powder metal aluminum alloys both with and without the silicon addition. All samples were heat treated to the T6 condition.

TABLE II

| | Tensile Properties | | | | |
|---|---|---|---|---|---|
| Alloy | Yield (MPa) | UTS (MPa) | Elongation (%) | E (GPa) | Hardness (HRB) |
| Al | 287 ± 5 | 344 ± 5 | 4.5 ± 0.6 | 64 ± 1 | 62 ± 1 |
| Al—1Fe | 279 ± 7 | 336 ± 14 | 2.6 ± 0.7 | 67 ± 2 | 54 ± 2 |
| Al—1Ni | 263 ± 1 | 306 ± 13 | 2.3 ± 0.6 | 66 ± 1 | 53 ± 2 |
| Al—1Fe—1Ni | 287 ± 11 | 351 ± 13 | 2.7 ± 0.8 | 71 ± 2 | 70 ± 2 |
| Al—(Si) | 362 ± 6 | 403 ± 13 | 2.6 ± 0.2 | 65 ± 2 | 78 ± 2 |
| Al—1Fe—(Si) | 324 ± 9 | 365 ± 22 | 1.6 ± 0.4 | 67 ± 1 | 75 ± 2 |
| Al—1Ni—(Si) | 351 ± 7 | 386 ± 12 | 1.8 ± 0.0 | 67 ± 2 | 76 ± 2 |
| Al—1Fe—1Ni—(Si) | 366 ± 7 | 405 ± 8 | 1.9 ± 1.1 | 70 ± 3 | 75 ± 1 |

From Table II, it can be seen that yield strength, ultimate tensile strength, and hardness universally increased with the minor addition of silicon (0.2% by weight). The gains to yield and ultimate tensile strength are significant indicating improvements of approximately 45 to 88 MPa in yield and 30 to 80 MPa in ultimate tensile strength. Likewise, improvements to hardness are also exhibited, with gains of as much as 20 points on the HRB scale resulting from the addition of silicon. It can be seen that the amount of elongation slightly suffers; however, for many applications this drop in elongation is acceptable or non-problematic.

Table III below compares the T6 tensile properties measured for the alloys studied using machined tensile bars.

TABLE III

| Alloy | E (GPa) | YS (MPa) | UTS (MPa) | Ductility (%) |
|---|---|---|---|---|
| PM2618-Sn | 71 | 287 | 351 | 2.7 |
| PM2618-Sn—0.2Si | 70 | 366 | 405 | 1.9 |
| Wrought 2618 | 67 | 355 | 421 | 6.3 |

In the 2618-Sn system (matching the chemistry profile of the Al-1Fe-1Ni composition above, which includes tin), the $Al_9FeNi$ dispersoids are essentially a chemically benign hardening feature in much the same way as ceramic particles are (MMC). The obvious differences are that the ceramics are much harder and more durable. However, the one benefit of $Al_9FeNi$ dispersoids in comparison to the introduction of ceramic particles is that the $Al_9FeNi$ dispersoids are more homogenously distributed due to prealloying.

Ultimately, the PM alloy Al-1Fe-1Ni—(Si) emerged as the most desirable system among the test specimens. The magnitude and stability of this alloy's hardness rivaled that of the high performance wrought alloy 2618-T6 and was greatly superior to that of the widespread commercial PM alloy AC2014-T6.

While experimental data for one specific aluminum alloy system has been provided above, the use of silicon additions may be used to create mechanical improvements in other alloy systems with modified compositions or alloying additions.

For example, although only up to 1 weight percent of each of iron and nickel are provided in the experimental data above, it is contemplated that the combined iron and nickel content might be up to 4 weight percent combined of the powder metal material. Compositions of 1 weight percent iron and 1 weight percent nickel were only provided above for comparison with the composition found in wrought aluminum alloys. In wrought systems, this 1 weight percent iron and 1 weight percent nickel likely represents the maximum amounts of iron and nickel that can be added due to complications with casting and forming processes that make the production of a defect-free product very challenging. When prealloying iron and nickel in a powder metal, their percentages can be pushed higher than in wrought castings and the powder metal is compactable and sinters into a sound product. These higher nickel and iron concentrations may be of benefit provided that the nickel and iron content are relatively balanced. Balancing the elements avoids a loss of strength in the alloy as it minimizes the formation of secondary intermetallics that tend to consume the elements related to precipitation hardening (copper, magnesium, silicon).

Further, the copper and magnesium contents in the aluminum alloy may be modified and still receive the benefit of the silicon addition. It is contemplated that copper may be varied within a range of 1 to 5 weight percent and that magnesium may be varied within a range of 0.5 to 2 percent. The compositions of workable systems include, for example, Al-2.5Cu-1.5Mg and Al-1.5Cu-0.75Mg. Alloys strengthened by the S-phase ($Al_2CuMg$) and its meta-stable variants are believed to typically be the most responsive to silicon additions.

Other alloying elements in addition to those discussed above might also be added in the aluminum alloy powder mixture. It is contemplated that other transition elements such as titanium and manganese might be added up to 2 weight percent total. Other elements, such as zirconium might be added in an amount up to 1 weight percent, although it likely more preferable for any zirconium addition to be approximately 0.2 weight percent.

Still yet, it is contemplated that this material may serve as a base for a metal matrix composite (MMC) in which ceramic additions may be made in an amount up to 20%.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A powder metal composition comprising:

an atomized aluminum powder metal in which the aluminum powder is prealloyed with a member selected from the group consisting of iron separately, nickel separately, and iron and nickel together;

a first master alloy powder metal comprising aluminum and copper;

a second master alloy powder metal comprising aluminum and silicon;

a first elemental magnesium powder metal; and a second elemental tin powder metal;

wherein the weight percent of silicon in the powder metal composition is in a range of 0.1 to 0.3 weight percent.

2. The powder metal of claim 1, wherein the second master alloy comprising aluminum and silicon is an Al-12Si master alloy.

3. The powder metal of claim 1, wherein the first master alloy powder metal comprising aluminum and copper is an Al-50Cu master alloy and wherein the second master alloy comprising aluminum and silicon is an Al-12Si master alloy.

4. The powder metal of claim 1, wherein the powder metal composition includes 2.3 weight percent copper, 1.6 weight percent magnesium, 0.2 weight percent tin, and 0.2 weight percent silicon.

5. The powder metal of claim 4, wherein the powder metal composition includes 1.0 weight percent iron.

6. The powder metal of claim 4, wherein the powder metal composition includes 1.0 weight percent nickel.

7. The powder metal of claim 4, wherein the powder metal composition includes 1.0 weight percent iron and 1.0 weight percent nickel.

8. The powder metal of claim 1, wherein the weight percent of silicon in the powder metal composition is 0.2 weight percent.

* * * * *